US008376409B2

(12) United States Patent
Rosset

(10) Patent No.: US 8,376,409 B2
(45) Date of Patent: Feb. 19, 2013

(54) SECURITY SHEET COMPRISING A FIBROUS SUBSTRATE

(75) Inventor: Henri Rosset, Le Pin (FR)

(73) Assignee: Arjowiggins Security, Issy les Moulineaux (FR)

( * ) Notice: Subject to any disclaimer, the term of this patent is extended or adjusted under 35 U.S.C. 154(b) by 611 days.

(21) Appl. No.: 12/443,550

(22) PCT Filed: Oct. 11, 2007

(86) PCT No.: PCT/FR2007/052126

§ 371 (c)(1),
(2), (4) Date: Jun. 11, 2009

(87) PCT Pub. No.: WO2008/043965

PCT Pub. Date: Apr. 17, 2008

(65) Prior Publication Data

US 2010/0071609 A1 Mar. 25, 2010

(30) Foreign Application Priority Data

Oct. 12, 2006 (FR) ..... 06 08949

(51) Int. Cl.
*B42D 15/00* (2006.01)

(52) U.S. Cl. ..... 283/72; 162/103

(58) Field of Classification Search ..... 162/140
See application file for complete search history.

(56) References Cited

U.S. PATENT DOCUMENTS

| | | | | |
|---|---|---|---|---|
| 3,463,590 | A * | 8/1969 | Bressler et al. | 356/71 |
| 3,533,176 | A * | 10/1970 | Hogstrom et al. | 283/92 |
| 4,310,591 | A * | 1/1982 | Lee et al. | 428/67 |
| 4,504,357 | A * | 3/1985 | Holbein et al. | 162/123 |
| 5,161,829 | A * | 11/1992 | Detrick et al. | 283/91 |
| 5,465,301 | A * | 11/1995 | Jotcham et al. | 380/54 |
| 5,567,276 | A * | 10/1996 | Boehm et al. | 162/103 |
| 5,961,152 | A * | 10/1999 | Washburn et al. | 283/72 |
| 6,447,630 | B1 | 9/2002 | Disano et al. | |
| 6,616,190 | B1 * | 9/2003 | Jotcham | 503/200 |
| 6,616,803 | B1 * | 9/2003 | Isherwood et al. | 162/103 |
| 8,100,334 | B2 * | 1/2012 | Rosset | 235/487 |
| 2002/0112833 | A1 * | 8/2002 | Beghello et al. | 162/140 |
| 2002/0166647 | A1 | 11/2002 | Attenberger et al. | |
| 2007/0108386 | A1 | 5/2007 | Krul et al. | |
| 2011/0056638 | A1 * | 3/2011 | Rosset | 162/109 |

FOREIGN PATENT DOCUMENTS

| | | | |
|---|---|---|---|
| CA | 2058268 | A1 | 6/1992 |
| EP | 0 229 645 | A1 | 7/1987 |
| EP | 0 492 407 | A1 | 7/1992 |
| EP | 0 557 157 | A1 | 8/1993 |
| EP | 0 930 174 | A2 | 7/1999 |
| EP | 1 002 640 | A1 | 5/2000 |
| EP | 1 253 241 | A2 | 10/2002 |
| EP | 1 276 079 | A1 | 1/2003 |
| FR | 2 679 934 | A1 | 2/1993 |
| FR | 2 847 915 | A1 | 6/2004 |
| GB | 2 260 772 | A | 4/1993 |
| WO | WO 2005/034049 | A1 | 4/2005 |
| WO | WO 2006/095033 | A1 | 9/2006 |

* cited by examiner

*Primary Examiner* — James Kramer
*Assistant Examiner* — Shin Kim
(74) *Attorney, Agent, or Firm* — Oliff & Berridge, PLC

(57) ABSTRACT

The present invention relates to a security film comprising a fibrous substrate incorporated at least partially in which is a security strip that comprises at least one security element and that extends between two edges of said fibrous substrate, said security strip being made of paper and comprising an adhesive.

64 Claims, 4 Drawing Sheets

SECURITY SHEET COMPRISING A FIBROUS SUBSTRATE

The invention relates to the field of security documents. It relates to a security film comprising a security tape and also the method for fabricating the security film. It also relates to the security tape itself.

Security documents are produced from materials that are in particular fibrous and may in particular be banknotes, identity cards, passports, driving licenses, visas, checks, stock certificates, transportation tickets or entrance tickets to a cultural or sports event.

During the fabrication of a security film intended for the preparation of a security document comprising band security elements, there are two main methods for obtaining bands containing said security elements: either small security elements are introduced, for example such as planchets which are plastic and/or paper, flat and relatively small format elements, or such as colored or luminous fibers, or a fine tape commonly called "security thread" is introduced. This tape is generally made from plastic and comprises security elements, for example luminous security elements.

The introduction of relatively small format security elements such as fibers or planchets in a band can be carried out in particular if the paper machine is a Fourdrinier machine, by a laminar flow of a jet containing a suspension of said security elements above a sheet of paper in formation which is then pressed and dried by the common papermaking process. This method of introduction is described for example in patent application EP 1 253 241.

In the case of a paper machine equipped with a cylinder mold, the introduction of said security elements in a band can be carried out in particular by feed ducts placed along the width and terminating in the mold close to the cylinder mold, before the start of the drainage of the fibrous suspension on the thread cloth of the cylinder mold. After drainage, the security film obtained is then pressed and dried by the common papermaking process.

The main drawback of said first method for obtaining a band containing security elements is the nonuniform distribution of said security elements. Due to the method of introduction of the elements, it is in fact difficult to obtain a band whereof the edges are uniform and within which the distribution of the security elements is relatively uniform, in the width (x) and in the length (y) but also in the thickness (z) of said security film.

These variations in band width and spatial distribution (x,y,z) of the security elements may in particular be problematic in the case of recognition and/or authentication and/or identification based on the spatial distribution (x,y,z) of said security elements in said security document. In fact, due to the excessive variability, the use of the position or of the width of said band, or even of the spatial distribution of said security elements, for purposes of recognition and/or authentication and/or identification, may in particular be unfeasible.

In the context of the present invention, the terms "recognition", "authentication" and "identification" are defined as follows: "recognition" applies when a document or an element of a document is compared to a reference in order to determine the authenticity of said document or of said element, "authentication" corresponds to the act of determining whether the document is authentic or if it has been falsified or counterfeited, and "identification" corresponds to the checking of the identity of the owner of a given document.

The type of problem mentioned above is encountered in particular in the case of an automatic authentication of security elements using a stationary device based on the specific signal of one or more security elements. In fact, some of said security elements are covered with a layer of fibers and/or mineral fillers that is too thick to allow satisfactory detection of their specific signals by said automatic authentication device. Thus, for a signal having a given strength, a larger quantity of security elements must be introduced in order to compensate for the loss of strength of the signal.

According to said second method for obtaining a band containing security elements, said security threads introduced generally have a width lower than 10 mm, a thickness of between 12 and 45 μm and, in most cases, consist of plastic tapes, particularly based on polyester.

Said security threads are securized in particular by patterns that are visible or not, in positive and/or in negative, of optically variable devices and in particular of holograms, of luminescence and in particular of fluorescence, of magnetism, of electric conduction or else of thermochromics.

Said security threads are incorporated within the fibrous substrate constituting said security film either "in bulk" that is entirely covered with fibrous material, or "in window", said security thread then being located on the surface of said security film and in bulk therein, for example alternately. In particular, the windows thus described may be through windows or not, according to whether said security thread appears respectively on both sides or on a single side of said security film.

The introduction of said security films in bulk may be carried out in particular in a single ply, on a Fourdrinier or cylinder mold paper machine. In the case of a cylinder mold, the thread is introduced into the mold before or shortly after the start of the drainage of the fibrous suspension on the thread cloth. The position of said security thread in the thickness of the final security film is determined in particular by the place and inclination of introduction of said security thread. The ply thus obtained may then be matched in the moist state, that is before drying, with other plies of which the fibrous compositions may be identical or different, and which may be formed on Fourdrinier or cylinder mold paper machines.

Another method for introducing said security threads in bulk is to incorporate them between two successive plies produced on a Fourdrinier and/or cylinder mold, before the "matching" of said successive plies by pressing in the moist state. Said plies may themselves be matched with other plies whereof the compositions may be identical or different and which may be formed on a Fourdrinier or a cylinder mold, before or after the introduction of said security threads. After their matching, the two successive plies comprising said security threads are optionally matched with other plies and then dried by the common papermaking process used to obtain a security film.

The introduction of a security thread in a window in a single ply is described for example in patent applications EP 059 056 for a cylinder mold paper machine and EP 0 609 252 for a Fourdrinier paper machine. The introduction in a window between two plies of a multiply fibrous material is described in patent application EP 229 645.

In order to improve their adhesion in the fibrous substrate, said security threads may in particular be coated with an adhesive, for example with heat sealing products also called hot reactivable products.

The introduction of said security threads may in particular cause a poor overlapping of said security threads characterizing it, when they are introduced in bulk, due to a lack of material above said security threads and, when they are introduced in a window, by insufficient bridgings. Bridging means the fibrous overlapping of a security thread introduced in a window in the zones between the windows, that is at the locations where the thread is contained in the mass of said security film. These lacks of fibrous material on said security thread are commonly referred to by the expression "sparkling effect". They are especially pronounced when said security film in which said security threads are introduced has a low basis weight.

This sparkling effect is reflected in particular by visual defects on said security film and by a fragilization of said security film, thereby constituting a drawback of the security films of the prior art containing said security threads.

Furthermore, the incorporation in bulk or in window of security threads of which the width exceeds about 1.5 cm is difficult because it causes fractures of the fibrous sheet in the "wet end" of the paper machine, that is before drying of the paper sheet. Moreover, the further upstream the fractures of the sheet occur on the paper machine, the more they are problematic, on the one hand because the route for conveying the sheet to the winder is longer, and also because this route is more difficult to achieve, owing to the lower dryness and hence the greater fragility of the sheet. A fracture of the sheet in the wet end is therefore more problematic than a fracture in the drier, insofar as it demands longer times for cleaning, restarts and finetuning of production.

These fractures may in particular result from overlapping defects of said security threads and of the insufficient bridgings discussed above. In fact, the wider said security threads are, the more pronounced said defects. This results in a greater fragilization of the film, particularly along the introduction bands of said security threads, and in consequence a greater frequency of fractures of the film.

Moreover, adhesives, for example heat sealing coatings, which may be added to said security threads, only develop their adhesive properties after the drying of said sheet of paper containing said security threads, and since the plastics constituting such security threads are water-repellant, said security threads of the prior art develop no bond with the fibrous substrate of said security film during the drainage and pressing which take place in the wet end, that is before drying of the sheet. In consequence, the introduction of said security threads fragilizes said security film along an introduction band, the adhesion properties of said security thread coated with an adhesive, for example with a heat sealing product, only being developed during the drying.

Furthermore, if said security threads are too wide, their impermeability hinders the drainage of the water present in the fibers located above the threads and thereby prevents the consolidation of the fibrous web, which in particular causes fractures of the sheet of paper in the wet end, during the production of security films containing said security threads. When the width of said security films exceeds about 1.5 cm, the fibrous web is no longer solid enough and causes an excessive number of fractures of the sheet of paper to allow satisfactory machinability of the paper machine.

Due to the technical problems discussed in the preceding paragraphs, said security threads have the particular drawback of their limited width.

The materials of which said security threads are made are generally plastic films which are optionally metalized and then optionally coated with varnish.

Another drawback of said security threads is that they can only be combined with very fine particles and, in particular, by printing and/or metalization. By way of example, the incorporation of flat and relatively small format security elements, such as planchets, is impossible because of the materials of which said security threads are made.

European patent application EP 0 557 157 of the Applicant describes the fabrication of a security film having monochrome or polychrome signs visible in transmitted light. This security film is fabricated from at least two fibrous plies and a band comprising monochrome or polychrome marks, introduced between two fibrous plies. The band thus introduced advantageously comprises cellulose fibers and a soluble and/or fusible binder so that said product can be dispersed during the incorporation of the band between the two plies so that the band disappears within the film and so that the printed marks are intimately linked with the film. The band thus obtained is completely destructured within the security film.

French patent application FR 2 679 934 of the Applicant describes a system for authenticating a security paper by means of a first chemical reagent present on the security paper, an authentication composition comprising a second chemical reagent forming a colored product with the first chemical reagent and a composition of erasure of the colored product. The chemical reaction occurring during authentication between the second reagent and the first chemical reagent only causes a coloration of the zone where the reaction occurs.

International application WO 2006/095033 relates to a security band comprising a tape of a cellulosic support formed of plant fibers. The cohesion and integration of the tape in the substrate of the band are ensured by the creation of chemical bonds between the plant fibers contained in the tape and in the substrate, particularly hydrogen bonds, but do not allow the band to retain its integrity and its cohesion within the substrate of the band, particularly when the band is placed in a wet medium, in the case of an attempt to recover the band by a counterfeiter, for example.

It is an object of the invention to further improve the security films.

For this purpose, the invention relates to a security film comprising a fibrous substrate in which is incorporated, at least partially, a tape extending between two edges of said fibrous substrate, said security tape being made of paper.

In a preferred exemplary embodiment of the invention, the security tape comprises at least one adhesive, for example a heat sealing agent.

In a preferred exemplary embodiment of the invention, the tape also comprises at least one security element.

Preferably, the tape extends between two opposite edges of said security film.

The term "substrate" designates a fibrous sheet which may in particular comprise one or more fibrous layers. In particular, the term "plies" is used to designate layers produced continuously on the same paper machine and then joined together in the moist state.

The invention may be suitable for supplying a security film with security elements disposed in a band in a relatively uniform spatial distribution (x,y,z).

The abovementioned adhesive serves to optimize the adhesion of the security tape in the security film.

The adhesive may for example be a heat sealing coating, for example a heat sealing varnish, a crosslinkable agent under ultraviolet (UV), an adhesive to be irradiated, a pressure sensitive adhesive (PSA), a varnish with a solvent base, of the polyester type for example, an aqueous phase adhesive, etc.

As an aqueous phase adhesive, mention can be made in particular of the following trade marks: Mowilith DC (aqueous dispersion of homopolymer vinyl acetate with particles ranging from 0.3 μm to 2 μm in size and a glass transition temperature $T_g$ of about 38° C., and a dry solid matter content between 55 and 57%) and Vinamul 3265 sold by Celanese; DH9004, DH9017, DH9044 and DL5001 sold by Collano;

Primal NW1845, Primal LC40, Primal P308M and Primal EP6000 sold by Rohm & Haas; and 006SDW078-2 sold by BASF.

The adhesive may advantageously be an adhesive based on polyvinyl acetate such as Mowilith DC.

The Applicant has found that among the above-mentioned adhesives, Vinamul 3265, Mowilith DC, Collano DL5001, Primal NW1845 and Primal P308M have very good results in the dry creasing test, that is, the porosity of the paper is not excessively affected by creasing.

Moreover, Vinamul 3265 and Mowilith DC also have very good results in the wet crumpling test. Mowilith DC has very good results in the washing test.

Thus, Mowilith DC procures excellent results in terms of adhesion capacity, but the invention is not limited to a particular adhesive.

According to one exemplary embodiment of the invention, the adhesive is not present in fiber form, nor in particulate form.

The adhesive can be incorporated in the security tape by coating.

The coating can be carried out at least partially in the body, that is in depth, or even in the entire security tape, or on the surface.

Preferably, the coating is carried out on the support serving for the fabrication of the tape before the cutting of the support. As an alternative, the coating can be carried out during the fabrication of the support serving to fabricate the security tape.

The coating can be carried out on a single side of the support or on both sides thereof. The adhesive may completely cover the side on which it is deposited.

The adhesive can also be incorporated in the security tape by impregnation, by immersing the tape or the support serving to fabricate it in a bath.

The security tape preserves its own cohesion after introduction into the fibrous substrate. Thus, the structure of the security tape can be observable after its introduction into the fibrous substrate under certain conditions, for example in a cross section or in viewing by reflection or transmission. Thus, it may be possible to observe the security tape, thanks to differences in optical properties, for example differences in contrast, color, saturation, brightness, opacity, which make a borderline visible between the tape and the substrate or characterize the presence of the tape.

In order to identify the presence of the adhesive in a security film according to one exemplary embodiment of the invention, it is possible to observe the adhesive, for example the heat sealing varnish, in the form of bubbles, for example using a scanning electron microscope (SEM).

The security tape may be observable by topography in the film.

The security tape may be observable by transparence in the film, particularly by the naked eye.

The security tape may comprise at least one security element on one of its sides, or even on both of its sides. The security tape may comprise different security elements on each side.

The security tape may have irregularly shaped edges, for example having the shape of broken or wavy lines, notches, zigzags, among others. The edges of the security tape may have the same shapes or different shapes, regular or irregular.

The security tape may be transparent or translucent or even opaque, for example having a dark appearance, in particular darker than the substrate. It may or may not be introduced as a window into the fibrous substrate. The introduction as a window may serve in particular to obtain various changes in opacity when the security tape is opaque. The security tape may optionally be combined with a thermoplastic and/or metal band, for example made from PET, pasted or hot laminated on the tape before its introduction into the fibrous substrate.

The security tape may even have various features perceptible for example by sight or by touch.

The security tape may for example be embossed, thereby serving to create a particular effect, for example a tactile or surface relief effect, the tape possibly partially appearing on the surface of the fibrous substrate.

The security tape may be coated with a thermoplastic polymer and optionally embossed after this coating.

The security tape may be printed with drops of varnish, resin or heat-swelling ink, inter alia.

When the tape comprises printing, this may for example serve to obtain variable optical effects.

The security tape may comprise a heat-swelling ink serving to create at least one relief, this ink being activated before introduction of the tape into the fibrous substrate. The activation before incorporation serves to reduce the risk of destructuration of the film during the swelling of the ink.

The security tape may comprise particles, for example detectable by the naked eye or to the touch, introduced in bulk in the security tape, for example in the form of beads, for example beads of a synthetic material, for example polyurethane, or a mineral material, for example glass, having a size for example lower than 300 μm, or by deposition by screen printing or photogravure, for example in the form of beads, for example having a size lower that 100 μm.

The security tape may comprise a textile band, for example knitted, integrated with the tape or pasted to the tape.

The security tape may comprise a relief printing, for example one screen printed.

The security tape may have a greasy, rough, smooth, silky, soft appearance to the touch, inter alia.

The security tape may in particular comprise deposits of polymers, particularly in the form of beads, for example beads of polyurethane (PU), beads of glass, polyamides 6 or 12, styrene-acrylic pigments, waxes or beads of polypropylene (PP), polyethylene (PE), polyvinyl chloride (PVC), of polymers based on methyl methacrylate, the tape being introduced for example in a window.

In order to obtain said security tape, a fibrous sheet may first be fabricated, preferably having a low basis weight, for example between 15 and 90 g/m$^2$, by a common papermaking process, that is for example by drainage of a fiber suspension optionally comprising conventional fillers and additives in papermaking, the optional specific security elements, pressing of the fibrous web obtained and then drying. This sheet is then optionally calendared, which serves in particular to reduce its thickness, and is then cut to form tapes which are then wound in reels.

The addition of the adhesive to the security tape may be carried out in particular by an application method, for example coating, or by methods issuing from techniques of printing of a paper base after its fabrication, for example air-brush coating, photogravure, screen printing, curtain coating, flexography, inter alia.

The photogravure method is preferably employed.

As an alternative, the security tape can be coated during the fabrication of the fibrous sheet, for example by surface coating, by size press or by impregnation.

The application of the adhesive, for example on a fibrous sheet serving for the fabrication of the tape, can be done for example at the rate of 2 to 15 g/m$^2$ per side, preferably between 3 and 8 g/m$^2$ per side.

The sealing temperature may vary between 70 and 135° C., for example, depending on the adhesive employed, and the sealing may take place during the drying of the security film.

In one exemplary embodiment of the invention, a fibrous sheet of 20 g/m$^2$, having undergone a wet strength treatment, is coated with an aqueous phase adhesive at the rate of 5 g/m$^2$ per side, using a photogravure method for example. A satisfactory compromise is thereby obtained between adhesive power and quantity of material applied.

The introduction of said security tapes within said fibrous substrate can be carried out in particular according to the methods for introducing plasic security threads of the prior art, as previously described or by pasting said security tapes between two fibrous sheets or layers which then constitute the base of said fibrous substrate.

Said security film proposed by the Applicant comprises at least one paper security tape which may be wider than said security threads of the prior art, without necessarily causing defects of fibrous overlap or insufficient bridgings as previously described. This results in particular from the permeability of said paper security tapes which favors drainage, and also the good affinity between the fibers of said paper security tape and the fibrous material of said substrate.

Furthermore, said security tapes may be incorporated into said fibrous substrate without causing an increase in the frequency of fractures of the film, particularly due to the preferable composition of said paper security tapes. In fact, said security tapes preferably comprise hydrophilic fibrous materials, in particular such as cellulosic fibers or synthetic fibers or optionally mineral fibers treated by sizing, in order to develop bonds with said fibrous substrate which serve to reduce its fragilization due in particular to the introduction of an element into said fibrous base. Sizing is a coating of the fibers which serves in particular to make them hydrophilic.

A good cohesion of said security film can consequently be obtained, as well as good machinability in the wet end, and the possibility of introducing security elements along relatively wide bands.

In comparison with the prior art consisting in the introduction of small security elements in a band, by laminar flow above a security film in formation on a Fourdrinier or by at least one localized feed during the formation of a security film in a mold, the present invention is suitable, if desired, for obtaining said elements along a band whereof the limits are clear and within which the distribution of the security elements is uniform.

Moreover, due to the method of incorporation of said security tape into said fibrous substrate, the positioning of said security elements of said paper security tape in the thickness of said security film is improved. This solves the problems described above which occur in particular during certain authentications based on the spatial distribution (x,y,z) of said security elements.

According to one exemplary embodiment of the invention, said substrate comprises, in addition to said security tape, at least one security element selected from markers, in particular nanometer-sized markers, security fibers, in particular metallic, magnetic (having soft and/or hard magnetism), or absorbent ones or ones which are excitable in the ultraviolet (UV), the visible or the infrared (IR), and in particular the near infrared (NIR), flat and relatively small format security elements such as planchets, pigments or pigment aggregates, in particular absorbent ones or ones which are excitable under laser lighting or in the ultraviolet (UV), the visible or the infrared (IR), in particular the near infrared (NIR), and security threads (generally based on plastics, in particular polyester) comprising in particular an at least partial metallic, metalized, iridescent or magnetic (having soft and/or hard magnetism) coating, said coating possibly comprising in particular patterns in positive or negative and said patterns possibly being obtained in particular by demetalization, the chemical or biochemical reagents for antifalsification and/or authentication and/or identification possibly reacting in particular with at least one falsification and/or authentication and/or identification agent respectively, and the optically variable elements in particular holograms, liquid crystals, iridescent pigments or mirror effect structures, in particular dielectric layers, and combinations thereof.

Said fibrous substrate may in particular comprise security elements visible to the naked eye but it may also comprise markers in the form of active material, particles or fibers, capable of generating a specific signal when these markers are subject to an optronic, electric, magnetic or electromagnetic excitation. These "markers" constitute a substance identifiable thanks to a distinctive property and used to mark an element (a security document in the present case) to provide for its tracking, the tracking of its variation, or to permit its recognition, its authentication or its identification.

Dielectric structures with a mirror effect consist of alternating high and low index layers, for example of hafnium dioxide and silicon dioxide respectively, and may in particular be obtained by ion etching.

The paper security tape may be based on cellulosic fibers (in particular cotton fibers) and/or natural organic fibers other than cellulosic fibers and/or synthetic fibers, for example such as polyester or polyamide fibers, and/or optionally mineral fibers, for example such as glass fibers. The security tape may not comprise polyvinyl alcohol (PVA) fibers.

Preferably, said fibers are hydrophilic, in particular in order to develop chemical bonds, mainly hydrogen bonds, with said fibrous substrate.

Preferably, said security tape comprises at least 50% by weight of cellulosic fibers.

According to the invention, the fibrous substrate is based on fibers as described above for the tape.

According to a particular case of the invention, the fibrous substrate and said security tape are based on the same fibers, that is, their fiber composition is the same in terms of type and preferably in the same proportions, allowing a good affinity between the two components, and which may, in addition, provide an additional means of authentication.

According to a particular case of the invention, said security tape has a width of between 2 and 60 mm, preferably between 4 and 30 mm and more preferably between 10 and 20 mm.

In particular, said security tape may comprise perforations, in particular to promote the drainage during the fabrication of said security film.

According to another exemplary embodiment of the invention, said security tape has a thickness of between 20 and 120 μm, preferably between 30 and 80 μm and more preferably between 45 and 55 μm.

According to another particular case of the invention, said security tape comprises at least one watermark pattern.

According to a particular case of the invention, said fibrous substrate comprises at least one watermark pattern.

According to a particular case of the invention, said fibrous substrate and said security tape each comprise at least one watermark pattern, said patterns being complementary by superimposition and/or combination.

In particular, said watermark patterns may be superimposed in order to obtain a moiré effect. Such an effect causes the appearance of a pattern produced in particular by the bringing together of lines during the superimposition of the two patterns having a periodic structure and a raster in particular.

The security tape may comprise a watermark and optionally perforations around this watermark.

The security tape may also be colored, in particular may have a different color from that of the substrate.

For a paper manufacturer producing watermarked documents, a further advantage of the invention in the case of a tape comprising a watermark, is the use of the usual sheet fabrication tools and processes. For example, he produces a stock of watermarked papers, colored or not, which he cuts and stores in tapes. At the appropriate time, these tapes are then introduced during the production of security films, thereby enabling the paper manufacturer to work with a "vellum cloth", that is to say one that is non-embossed. In fact, the embossing of the fabrication cloth which allows the formation of watermarks on the security films of the prior art has the particular drawback of requiring several days of work. Thus, the incorporation of watermarks disposed on paper security tapes serves to gain flexibility in terms of manufacturing schedules.

According to a particular case of the invention, said paper security tape comprises at least one security element selected from markers, in particular nanometer-sized markers, security fibers, in particular metallic, magnetic (having soft and/or hard magnetism), or absorbent ones or ones which are excitable in the ultraviolet (UV), the visible or the infrared (IR), and in particular the near infrared (NIR), flat and relatively small format security elements such as planchets, pigments or pigment aggregates, in particular absorbent ones or ones which are excitable under laser lighting or in the ultraviolet (UV), the visible or the infrared (IR), in particular the near infrared (NIR), and security threads (based on plastics, in particular polyester) comprising in particular an at least partial metallic, metalized, iridescent or magnetic (having soft and/or hard magnetism) coating, said coating possibly comprising in particular patterns in positive or negative and said patterns possibly being obtained in particular by demetalization, the chemical or biochemical reagents for antifalsification and/or authentication and/or identification possibly reacting in particular with at least one falsification and/or authentication and/or identification agent respectively, and the optically variable elements in particular holograms, liquid crystals, iridescent pigments, or mirror effect structures, in particular dielectric layers, and combinations thereof.

The incorporation of markers in a security document via a paper security tape is localized, thereby serving to create a zone, possibly invisible to the naked eye, of recognition and/or authentication of said security document. The recognition and/or authentication of said document can in particular be based on the intensity and/or type of the signal generated by the markers, considered individually or not, on the density of the markers, or else on the spatial distribution in a zone of the document that is predefined or not. In particular, randomly distributed markers can form a unique signature and thus be used for identification purposes.

In particular, the introduction into a security film of pigments or pigment aggregates absorbent in the infrared or in the near infrared as previously mentioned, can be used in order to make said film authentifiable, as described in patent application WO 2005/034049. The same application particularly recommends the use of kaolinite and talc in a mixture, products which are commonly used in the papermaking field, in a security film with a zone having variable distribution and watermarked in particular. The use of these compounds serves in particular to authenticate said security film by infrared spectroscopy, particularly the near infrared and a better optical reading of the bar code watermarks. However, the minimum quantity of these compounds to be introduced into said film to allow an optical reading and/or a proper authentication may be too high compared to the maximum quantities of ash defined in certain specifications. The present invention therefore serves to solve the above problem, for example by supplying a security film comprising a watermarked security tape based on fibrous material and a mixture of kaolinite and talc in sufficient proportions to promote the authentication of said document by infrared spectroscopy or the optical reading of said watermark. In fact, the content of kaolinite and talc is particularly high, but only in the zone containing said security tape, so that said security film comprising said security tape complies with the upper limits for ash content contained in said specifications.

In the particular case of a security tape according to the invention comprising magnetic fibers, one advantage of the invention concerns, for example the authentication of a security document by analysis of the signal of the magnetic response. In particular, the introduction by seeding, that is in a mixture in the fibrous suspension before its drainage, of fibers having a soft magnetism called "soft magnetic" fibers, serves to reproducibly obtain a uniform distribution of said soft magnetic fibers. On the other hand, the introduction of said soft magnetic fibers in a band according to the prior art, that is in a round shape with localized feed ducts or by laminar flow above a Fourdrinier, causes some variability of the concentration of said soft magnetic fibers, but also of the width of said band of soft magnetic fibers. By using a paper safety tape fabricated by cutting a film comprising soft magnetic fibers introduced in seeds, the invention serves to reproducibly obtain a uniform distribution of said soft magnetic fibers. Thus, by varying the concentration of soft magnetic fibers and the width of said security tape introduced, the number of possible "signatures" or magnetic signals is significantly increased.

According to a particular case of the invention, said paper security tape comprises at least two security elements selected from those mentioned above.

According to a particular case of the invention, said paper security tape comprises between 0.1 and 1% by dry weight of magnetic fibers, in particular having a soft magnetism, in comparison with the total amount of fibers, and preferably between 0.2 and 0.6%.

According to a particular case of the invention, said paper security tape comprises a plurality of planchets distributed in a surface density of between 4000 and 25000 planchets/$m^2$, preferably between 5000 and 20000 planchets/$m^2$ and preferably between 11000 and 18000 planchets/$m^2$.

According to a particular case of the invention, said security tape comprises a series of parallel security threads, and more particularly the succession of inter-thread spaces and/or the series of the various widths of said security threads constitute a code, in particular of the barcode type.

According to a particular case of the invention, said paper security tape comprises a anti-theft thread having soft magnetism.

This type of anti-theft security thread may be severely cutting and therefore difficult to incorporate in a security film, and it may occur in particular that said anti-theft thread, when introduced according to the prior art, that is directly into a fibrous substrate, is not totally covered with fibers. The incorporation of such a anti-theft security thread according to the present invention consists in the fabrication of a fibrous sheet in which a plurality of anti-theft security threads are introduced, said security film thereby obtained then being cut into tapes comprising at least one anti-theft thread. These tapes are then introduced into said fibrous substrate. Thus, the zones of said security tape which may have fibrous overlap defects are covered by the fibrous material of said fibrous substrate, and a security film is thereby obtained comprising at least one anti-theft security thread and free of overlap defects.

According to a particular case of the invention, said security tape comprises at least one electronic device. Preferably, said electronic device is a radiofrequency identification device, more commonly called RFID, and in particular an electronic chip and/or an aerial which may in particular be printed on said paper security tape.

According to a particular case of the invention, said paper security tape comprises at least one chemical or biochemical reagent for antifalsification and/or authentication and/or identification, reacting in a colored manner, to at least one falsification and/or authentication and/or identification agent respectively.

In particular, a paper security tape comprising a chemical or biochemical antifalsification reagent reacting in a colored manner to at least one falsification agent may in particular be located on a zone of inscription of variable wording subject to falsification. By way of example: on a check, this zone comprises in particular zones intended for the entering of the amount of said check in figures and letters, or the name of the recipient of the check.

If said paper security tape comprises a chemical or biochemical authentication reagent reacting in a colored manner to at least one authentication agent, an additional securization of the security film containing said paper security tape is obtained, the authentication reaction being in fact located on the zone where said paper security tape has been incorporated.

A further advantage of the above particular case is the ability to use at least one antifalsification reagent in documents intended to receive a surface treatment, particularly to promote the adhesion of the ink during the personalization of said documents. In fact, reagents of this type are not generally used because they are incompatible with mixtures of colloidal dispersions of polymers (latex) commonly used in the composition of said paper surface treatments; for example, mention can be made of the styrene-butadiene polymer latex sold under the trade name Latexia 301 by Ciba. Insofar as the tape is introduced in bulk, the invention therefore serves to incorporate said reagents in said paper security tape or to apply at least one of said surface treatments to said fibrous substrate without encountering this type of problem.

This particular case has the further advantage of allowing the use of antifalsification reagents which react with certain adhesives, and particularly those used on adhesive films, in particular for visas to be pasted on passports or for security films pasted on certain security documents. In fact, the fact of incorporating said reagents in said paper security tape serves to isolate the reagents and thereby to prevent any premature reaction between said reagents and said adhesives contained in particular on said adhesive films, without preventing the reaction with the reagents used during attempts at falsification of said security documents containing said adhesive films.

Furthermore, in the field of said security documents, a high level of brightness is sometimes required, and this may be incompatible with the use of some of said chemical or biochemical antifalsification and/or authentication and/or identification reagents. The incorporation of said paper security tape then serves to introduce these reagents into certain zones of a document while preserving the overall brightness of said document.

According to a particular case of the invention, said fibrous substrate comprises at least one chemical or biochemical reagent for antifalsification and/or authentication and/or identification, reacting in a colored manner to at least one falsification and/or authentication and/or identification agent respectively.

In particular, said paper security tape and said fibrous substrate each comprise at least one chemical or biochemical antifalsification and/or authentication and/or identification reagent reacting in a colored manner with at least one falsification and/or authentication, and/or identification agent respectively. Said chemical or biochemical antifalsification and/or authentication and/or identification reagents are preferably different and may in particular react with only one and the same agent or with two different agents.

According to a particular case of the invention, said security tape and said fibrous substrate of the security film each comprise at least one chemical or biochemical antifalsification and/or authentication and/or identification reagent, these reagents being chemically incompatible. In the context of the present invention, "chemically incompatible" means that the reagents may react together because they are in contact or because they initiate chemical reactions with the falsification or authentication and/or identification agents, which are incompatible.

In fact, in the prior art, the use of a single fibrous substrate sometimes prevents the combination of some of said chemical or biochemical antifalsification and/or authentication and/or identification reagents which, inserted into a common substrate, react together (incompatible reagents). Moreover, said chemical or biochemical antifalsification and/or authentication and/or identification reagents may be compatible but give rise to incompatible reactions during the attempt at falsification or authentication or identification of said security document, which means that said document is not damaged during its falsification or that the authentication reaction does not yield the anticipated result. The use of at least one tape according to the invention therefore has the advantage of allowing the use of at least two incompatible reagents or reactions.

According to a particular case of the invention, said security tape comprises perforations in a pattern or a code. Depending on the differences in opacity and color between said substrate and said security tape, said pattern or code is observable, or observable only in transmitted light or observable both in transmitted light and reflected light. If said security tape has an invisible fluorescent printing, said pattern may also be visible only under UV illumination.

In particular, said pattern produced by perforation comprises at least one alphanumeric character or one ideogram.

According to a particular case of the invention, said paper security tape comprises perforations in a pattern and further comprises a chemical or biochemical antifalsification and/or authentication and/or identification reagent reacting in a colored manner. During an attempt at falsification and/or authentication and/or identification of said document, said chemical or biochemical reagent reacts with the falsification and/or authentication and/or identification agent by a reaction that produces a particular coloration of said paper security tape. Said pattern produced by perforation then becomes visible by contrast between the coloration of said paper security tape and that of said fibrous substrate.

According to a particular case of the invention, said security tape is calendered. This calendering is carried out in particular to minimize the extra thickness created by the introduction of said paper security tape.

According to a particular case of the invention, said security tape is free of a surface coating, in particular free of a pigmented layer. The good affinity between said fibrous substrate and said security tape is thereby promoted.

According to another particular case of the invention and in particular to increase the affinity between said fibrous substrate and said security tape, said security tape comprises a water activable adhesive agent, for example a polyvinyl alcohol (PVA), in particular partially hydrolyzed.

According to a particular case of the invention, said paper security tape has a tensile wet strength above 30%, particularly to avoid causing problems during its introduction into said security film. The tensile wet strength is measured by dividing the value of the tensile wet strength measured according to standard NF Q 03.056 by the dry tensile strength measured according to standard NF EN ISO 1924. This wet strength can be provided in particular conventionally by the addition of a wet strength agent, for example such as a polyamine-amide-epichlorhydrin (PAAE) resin, a melanin formol resin, etc.

As an alternative, additional wet strength can be obtained by adding part of the tensile wet strength agent(s) to the surface treatment baths of a fibrous sheet, serving for example for the fabrication of the security tape.

According to a particular case of the invention, said security tape is incorporated in bulk or in window in said fibrous substrate. The tape may only appear on one side of the film in a window or appear on each side of the film in a through window.

According to a particular case of the invention, said fibrous substrate has a fibrous monolayer, in particular monopoly, or a plurality of fibrous layers, in particular multiply. Preferably, said fibrous substrate comprises two fibrous layers, in particular a two-ply structure.

According to a particular case of the invention, said security tape and at least one of the layers of said fibrous substrate have different colors. Greater securization is thereby obtained due to the presence of two fibrous layers of different colors in the same security film.

In particular and in order to increase the securization of the security document which comprises a security film according to the invention, said substrate of the security film and the security tape have different colors and each comprise a watermark pattern. The securization of said security document is thereby improved by the presence of two watermarks of different colors to be duplicated, particularly because the use of transparentizing inks, commonly employed to counterfeit watermarks, does not allow the creation of such color effects. Furthermore, this securization allows a rapid authentication of said security document, the coloration of said watermarks being in fact readily observable in transmitted light.

According to a particular case of the invention, said fibrous substrate comprises at least two paper security tapes as described previously.

In particular, if said security film comprises two security tapes, it is then possible for them to contain two different reagents respectively, thereby yielding two different localized colors by reaction with a single developing agent. It is also possible for said security tapes to react specifically with two different agents to produce two localized colors, which are different or not.

The invention also relates to a method of fabrication by papermaking procedure of said security film previously described, whereby said security tape based on fibrous materials is introduced in the wet end into said fibrous substrate. Said substrate-tape combination thereby obtained is then pressed and then dried.

According to a particular case of the invention, said security tape is introduced in the wet end, in bulk or in a window into said fibrous substrate. For this purpose, known methods can be used for introducing plastic security threads of the prior art. The tape may have any one of the features listed in detail above, or any combination thereof.

According to a particular case of the invention, the method uses a paper machine which is equipped with at least one cylinder mold, and said security tape is introduced into the mold of said cylinder mold, before or shortly after the start of the drainage of the composition forming said fibrous substrate of the film.

According to a particular case of the invention, the method uses a paper machine which is equipped with at least one Fourdrinier, and said paper security tape is introduced above said Fourdrinier, during the drainage of the composition forming said substrate of the film.

According to a particular case of the invention, said fibrous substrate comprises at least two plies, and said security tape is introduced before the joining of two successive plies in the moist state, that is, by the common papermaking process, before drying of the combination of security tape and fibrous plies of the substrate.

According to a particular case of the invention, said paper security tape as previously described is incorporated by pasting between two fibrous layers of said fibrous substrate of said security film.

In particular, said paper security tape may appear in a window, particularly if at least one of said layers comprises perforations or material-free zones.

The invention also relates to the paper security tape as previously described.

The invention also relates to a security document comprising a security film as previously described.

This document may be fabricated by cutting, joining, binding, lamination, bonding and/or pasting of this security film.

More particularly, said security document is a means of payment, such as a banknote, a check or a restaurant ticket, an identity document such as an identity card or a visa or a passport or a driver's license, a lottery ticket, a transportation ticket or else an entrance ticket to cultural or sports events.

The invention also relates to an article to be authenticated comprising said security film as previously described or obtained, said article being selected from a security label, a container, in particular a container for medicinal products or for foods or for perfumes or for electronic parts or for spare parts, a film used in the medical or hospital field, in particular a paper used to make sterilization packages, or else an art paper.

The invention also relates to a method for authenticating a security film comprising a security tape which comprises at least one chemical or biochemical antifalsification and/or authentication and/or identification reagent reacting in a colored manner with at least falsification and/or authentication and/or identification agent respectively, and also perforations in a pattern or a code. In the absence or before application of said falsification or authentication agent, said chemical or biochemical antifalsification or authentication and/or identification reagent having not reacted, said pattern or said perforated code is invisible. When said security film is placed in the presence of a falsification and/or authentication and/or identification agent, the reaction between said reagent and said agent causes a coloration of said security tape which makes said pattern or said perforated code legible.

Said method is therefore characterized in that the reaction between said antifalsification and/or authentication and/or identification reagent, and a falsification and/or authentication and/or identification agent respectively, imparts a coloration to said paper security tape making said perforations observable, in particular said pattern or said perforated code, on said security tape.

According to another of these aspects, the invention also relates to a security film comprising a fibrous substrate in which is incorporated, at least partially, a security tape preferably comprising at least one security element, extending between two edges of said fibrous substrate, said security tape being made of paper and comprising a watermark. The tape may have one or more of the above features.

According to a further of these aspects, the invention also relates to a security film comprising a fibrous substrate in which is incorporated, at least partially, a security tape, preferably comprising at least one security element, and extending between two edges of said fibrous substrate, said security tape being made of paper and having a different color from at least one layer of said fibrous substrate. In the context of the present invention, "different color" means a difference in color visible to the naked eye. The tape may have one or more of the above features.

The invention will be better understood from a reading of the nonlimiting examples and the figures that follow.

EXAMPLES PROPOSED

Example 1

We consider the production, on a cylinder mold paper machine, of a security film comprising a paper security tape comprising, as a security element, planchets comprising an invisible fluorescent impression and incorporated in a watermarked fibrous substrate.

Fabrication of the security tapes according to the invention:

A sheet of paper is fabricated on a Fourdrinier paper machine. The planchets printed with a fluorescent ink are added to the aqueous suspension of refined cellulose fibers of about 30° SR, the fibrous web containing these seeded planchets is pressed and dried. Said sheet obtained after drying has a basis weight of 45 g/m$^2$.

A sheet is thereby obtained comprising seeded invisible fluorescent planchets uniformly distributed in space, which is then calendered, coated by photogravure on the totality of its two sides with MOWILITH DC adhesive at the rate of 5 g/m$^2$ per side, and then cut into 1.5 cm wide tapes, said tapes being shown in FIG. 1. The tapes are wound.

Fabrication of the security film comprising a paper tape according to the invention:

During the fabrication of said fibrous watermarked substrate on the cylinder mold, said security tapes are introduced in bulk in the mold of the cylinder mold.

After drainage, pressing then drying of the substrate-tape combination, a security film according to the invention is obtained as shown from the front in FIG. 2 and in a cross section in the thickness in FIG. 3.

In an alternative in which the adhesion of the tape is not required, the tape is not coated with the MOWILITH adhesive, all the other steps being carried out.

Example 2

We consider the production of a security film comprising a paper security tape comprising, as a security element, soft magnetic fibers, incorporated in bulk in a fibrous substrate.

Fabrication of the security tapes according to the invention:

A sheet is fabricated on a Fourdrinier paper machine by the conventional method, that is by drainage, pressing then drying of an aqueous suspension of cellulose fibers refined to 32° SR. Said soft magnetic security fibers are fibers of an alloy of nickel and iron called Supermalloy®. These fibers have a diameter of 10 μm and an average length of 3 mm and are introduced in a mixture into the fibrous suspension at the rate of 0.70 by weight of the weight of the fibrous composition in the machine chest, that is before the formation of said sheet.

A sheet is obtained with a basis weight of 35 g/m$^2$, which is then calendered, coated with adhesive, for example by photogravure of both of its sides with the MOWILITH DC adhesive at the rate of 5 g/m$^2$ per side, then cut into 3.5 cm wide tapes. The tapes are optionally wound.

Security tapes are thereby obtained comprising soft magnetic fibers having a uniform spatial distribution.

Fabrication of the security film comprising a paper tape according to the invention.

The security film is fabricated on a Fourdrinier paper machine by introducing said security tapes in bulk into the fibrous composition forming the substrate. The security tapes are introduced during the drainage, between the fibrous web in formation and the dandy roll located on the forming table, and the sheet is then pressed. After drying, the security film thus obtained has a basis weight of 100 g/m$^2$.

Using an appropriate magnetic detector, the uniform distribution of magnetic fibers in the tape and the uniform width of said security tape serve to authenticate and/or identify said security film reliably.

In an alternative in which the adhesion of the tape is not required, the coating with adhesive is not carried out, all the other steps being reproduced.

In another alternative, the adhesive is deposited by size press.

Example 3

We consider the production, on a Fourdrinier paper machine, of a security film comprising a security tape having, as a security element, an iridescent layer, incorporated in a window in the fibrous substrate of the film.

Fabrication of the security tapes according to the invention:

On a Fourdrinier paper machine, a sheet of paper is fabricated based on cellulose fibers refined to 25° SR. The sheet thus obtained is calendered and then covered, by photogravure, with Iriodin® blue/pink mica-titanium iridescent pigments from Merck. The composition containing the pigments may also contain the adhesive, as a co-binder, for example the MOWILITH DC. This sheet, which weighs 55 g/m$^2$ is then cut into tapes 5 mm wide.

Fabrication of the security film comprising a paper tape according to the invention:

On a cylinder roll, the fibrous substrate of the film is formed in which said security tapes are introduced, to register and in a window, by the method for introducing security threads in a window on a cylinder mold paper machine described in patent application EP 059 056.

The resulting security film therefore comprises an iridescent coating appearing in dotted lines due to the introduction of said security tape in a window.

In an alternative, the adhesive is deposited on the pigment layer.

Example 4

We consider the production, on a cylinder roll paper machine, of a security film comprising a fibrous substrate of natural white color comprising a watermark, and of a yellow paper security tape comprising a watermark. Said tape and said substrate form a security film such that the two watermark patterns complement each other.

Fabrication of the security tapes according to the invention:

On a cylinder roll, from an aqueous suspension of cellulose fibers refined to 40° SR comprising a yellow dye, a sheet of paper is fabricated having a yellow color and the watermark according to a pattern representing a head of hair. The sheet, free of surface treatment and coating, thereby obtained weighs 70 g/m$^2$, and is then calendered, coated by photogravure with MOWILITH DC on both sides at the rate of 5 g/m$^2$ per side, and then cut into 5 cm wide tapes. Such a security tape is shown in FIG. 4*b*.

Fabrication of the security film comprising a paper tape according to the invention:

On a cylinder mold machine, the fibrous substrate of the film is formed from an aqueous suspension of refined cellulose fibers of about 38° SR and a watermark pattern is formed showing a face complementing the watermarked head of hair of the tape; said security tapes are introduced into the mass of the substrate undergoing formation to register so that the watermarks of the tape and of the substrate complement each other to form a face. According to the method of introduction of security threads in bulk on a cylinder mold paper machine, said security tapes are introduced during the drainage of the fibrous suspension on the cylinder mold, in the mold. After pressing and drying, a sheet is obtained with a basis weight of 80 g/m$^2$.

The resulting security film therefore comprises a two-color watermark visible in transmitted light, like the one shown in FIG. 4.

Example 5

In this example, the tape is not coated with adhesive, because it is not the strong adhesion of the tape in the substrate that is required. This example uses aspects of the invention that are independent of the presence of adhesive on the tape.

We consider the production, on a cylinder mold paper machine, of a security film comprising a fibrous substrate comprising a chemical authentication reagent reacting in a colored manner with an external authentication agent that may be present in an authentication pen and a paper security tape which itself comprises a chemical authentication reagent reacting in a colored manner with the authentication agent present in said pen.

Fabrication of the security tapes according to the invention:

On a Fourdrinier paper machine, a sheet of the overlay type is formed from an aqueous suspension of refined cellulose fibers, of about 30° SR, and a composition of paranitrophenol is introduced via a surface treatment of the sheet in a size press. This sheet of paper has a basis weight of 30 g/m$^2$ and therefore comprises paranitrophenol as a chemical authentication reagent that can react on its entire surface in a colored manner with slightly concentrated caustic soda (sodium hydroxide), the caustic soda being the external authentication agent contained in the pen. The paranitrophenol is colorless and assumes a yellow color in the presence of slightly concentrated caustic soda. The sheet free of coating thereby obtained is then calendered and cut into 2 cm wide tapes.

Fabrication of the security film comprising a paper tape according to the invention:

On a cylinder mold paper machine, the substrate of the film is fabricated from an aqueous suspension of cellulose fibers comprising another chemical authentication reagent also reacting in a colored manner with slightly concentrated caustic soda. This reagent is a colored indicator for a check derived from xanthene, it is colorless and assumes a blue color in the presence of slightly concentrated caustic soda, which is the authentication agent contained in said pen.

Said security tapes previously obtained are introduced in bulk during the formation of said substrate, by a common method of introduction in bulk of security threads on a cylinder mold paper machine as described in example 4.

The resulting security film has a basis weight of 80 g/m$^2$.

This film is authentifiable with an enhanced security level. In fact, by using on said film an authentication pen containing slightly concentrated caustic soda, a first blue color is caused to appear on the zones lacking any paper security tape and a second green color is caused to appear on the zones located above said paper security tape, said green color resulting from the mixture of the colors yellow and blue, respectively of said paper security tape and of said fibrous substrate.

Figure 1:
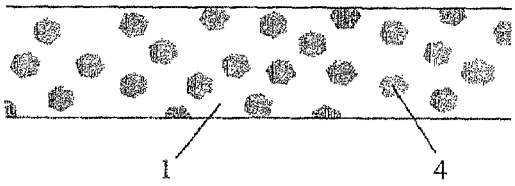
FIG. 1 shows a front view under UV illumination of a security tape 1 comprising planchets 4 printed with an invisible fluorescent ink.

The paper security tape 1 shown in FIG. 1 has a width of 1.5 cm and is securized by planchets 4 of about 3 mm printed with an invisible fluorescent ink so that they are visible only under UV illumination. The distribution of said planchets 4 in said paper security tape 1 is uniform and observation thereof under UV illumination reveals a band of which the edges are relatively uniform.

Figure 2:
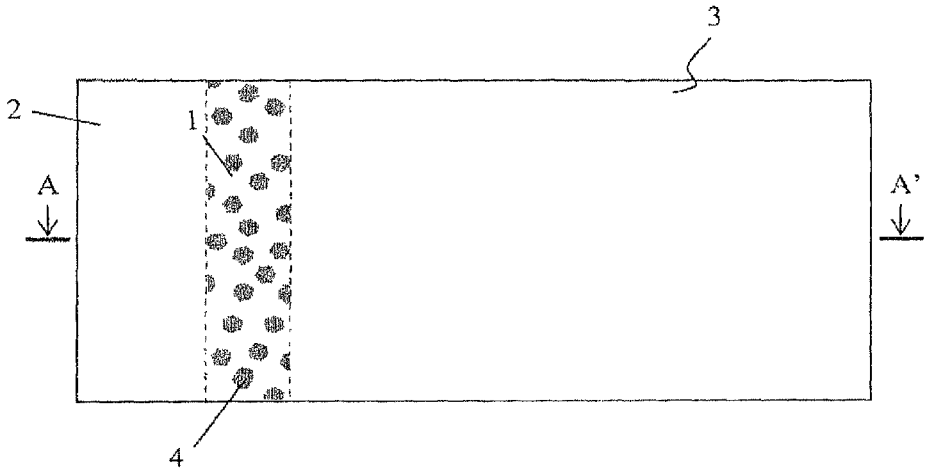
FIG. 2 shows a front view under UV illumination of a security film 2 containing said security tape 1 of FIG. 1.

An object of the invention 3 is shown in FIG. 2. It consists of a security film 2 having dimensions of 6×12 cm comprising in its bulk a paper security tape 1 securized by said planchets 4 and shown in FIG. 1. This paper security tape 1 is introduced at a distance of 2 cm from the edge of the security film 2. Said planchets 4 being invisible and fluorescent, they are invisible if observed in transmitted and/or reflected light. However, under UV illumination, said planchets 4 are observed, disposed along a band corresponding to said paper security tape 1, having a uniform distribution and relatively uniform edges.

Figure 3:
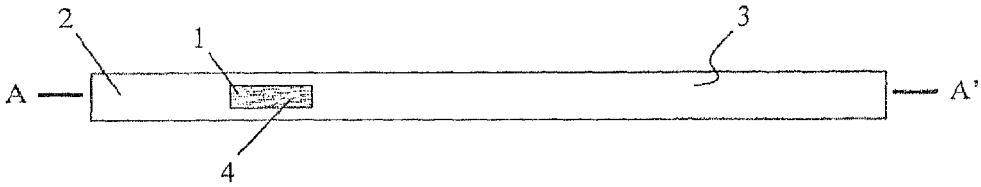
FIG. 3 shows a cross section in the thickness along (AA') of the security film 3 of the invention shown in a front view in FIG. 2.

A cross section along (AA') of FIG. 2 is shown in FIG. 3. This cross section in the thickness of said security film 3 of the invention reveals said paper security tape 1 comprising said planchets 4 and contained in the bulk of the security film 2.

Figure 4A:
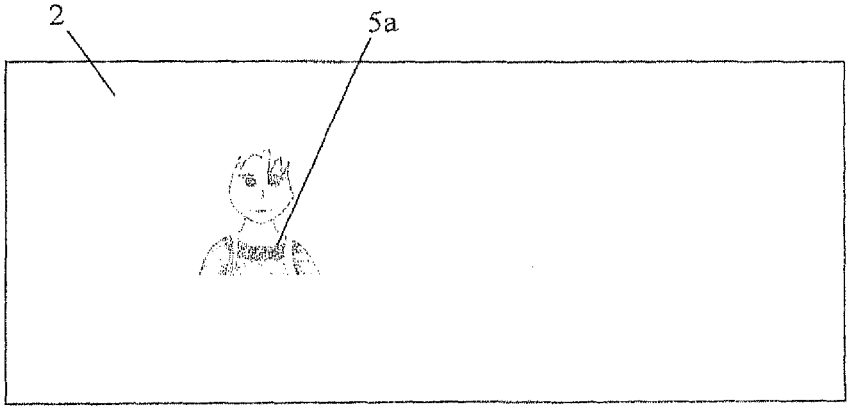
FIG. 4 shows, in a front view, an object of the invention 3, comprising a watermarked security film 2 shown in a front view in FIG. 4*a*, in which a watermarked paper security tape 1 is incorporated, shown in a front view in FIG. 4*b*.
Figure 4B:
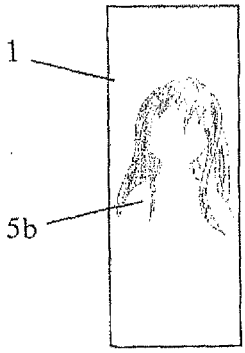
Figure 4:
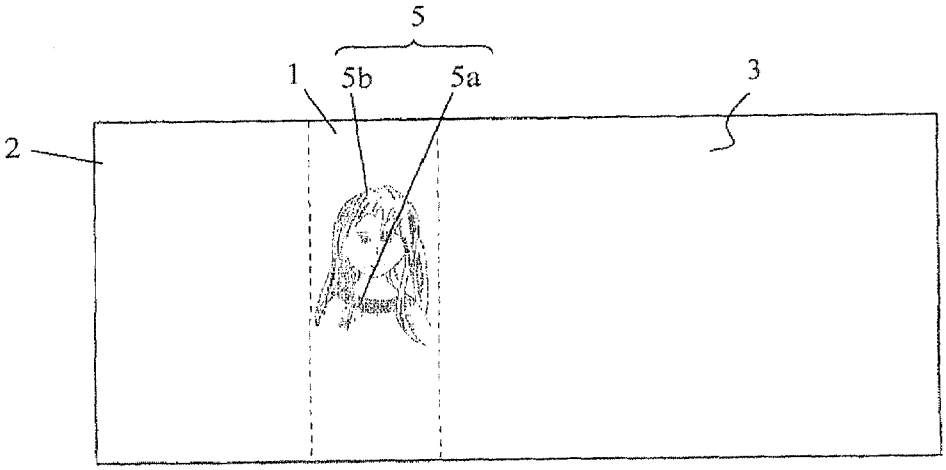

A further object of the invention 3 is shown in FIG. 4. It comprises a fibrous substrate 2 having dimensions 6×12 cm, watermarked and in which the watermark represents a face 5*a* as shown in the front view in FIG. 4*a*, and also a paper security tape 1 which is 5 cm wide, having a yellow color and watermarked, in which the watermark represents a head of hair 5*b* as shown in FIG. 4*b*. Said security film 3 comprising said paper security tape 1 at a distance of 4 cm from its edge is shown in FIG. 4, and contains a watermark 5 representing a head composed of a yellow head of hair 5*b* and a face 5*a* in gray shades.

Figure 5:
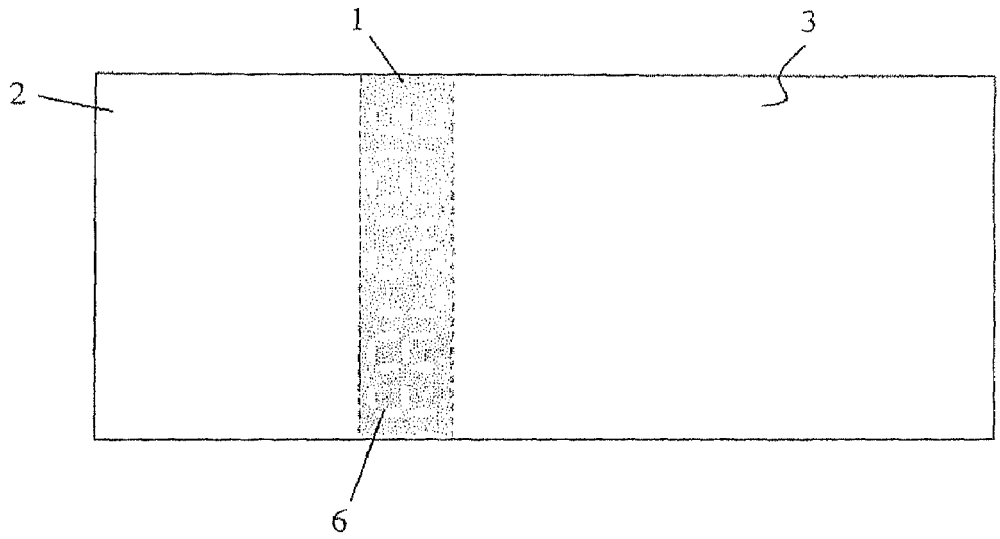
FIG. 5 shows a front view of the security film 3 of the invention in which a perforated paper security tape 1 is incorporated along a text and which comprises an antifalsification reagent reacting in a colored manner with the falsification agent.

An object of the invention 3 is shown in FIG. 5. It comprises a security film 2 having dimensions of 6×12 cm and in the bulk of which is incorporated a 2 cm wide paper security tape 1 which comprises perforations 6 having a diameter of 2 mm, and also a manganese sulfate which acts as colorless antifalsification reagent. Said perforations 6 form the word "FALSIFIE" [FAKE]. During the normal use of said object of the invention 3, said paper security tape 1 and said perforations 6 are not observable either in transmitted light or in reflected light. On the other hand, the same object of the invention 3 having been the subject of an attempt at falsification by dipping in a bath of sodium hypochlorite, and commonly used for the fabrication of manual transcriptions, is shown in FIG. 5. The manganese salt contained in said paper security tape 1 has reacted with the sodium hypochloride bath to yield a brown colored product. Said perforations 6 therefore become observable and reveal the word "FALSIFIE" [FAKE] in negative, indicating the attempt at falsification of said object of the invention 3.

It is possible to detect the security tape in various ways after incorporation in the security film.

For example, the tape may be detected by direct observation of the security film, with the naked eye in reflected light or in transmitted light. Differences in color, thickness and/or opacity between the tape and the fibrous substrate may serve to determine the presence of the tape.

Figure 6:
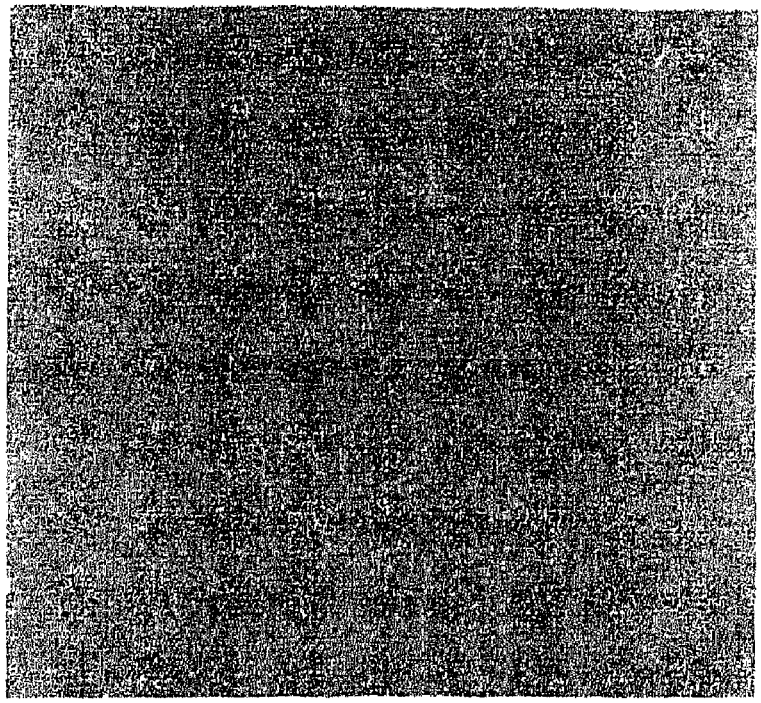
FIG. 6 shows a transparency image of a security film according to the invention, comprising a security tape.
Figure 7:
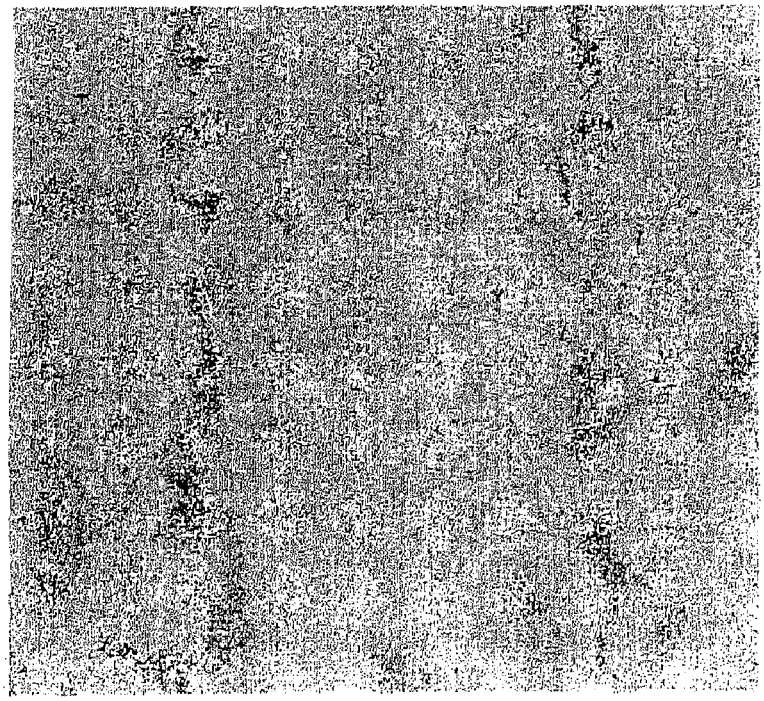
FIG. 7 shows a topographic image of a security film according to the invention, comprising a security tape.

As an alternative, it is possible to obtain an image of the security film by topography or by transparency, for example in order to observe the look-through and topography of the paper. For example, the presence of the security tape may be observed, particularly by differences in contrast, in FIGS. 6 and 7, which are respectively images of the security film by transparency and by topography.

Furthermore, it is also possible to identify the presence of the security tape by the presence of the adhesive, for example a heat sealing varnish, which may be observed in the form of bubbles by observation under scanning electron microscope (SEM).

The expression "comprising a" is synonymous with comprising "at least one".

The invention claimed is:

1. A security sheet comprising:

a fibrous substrate; and a security tape made of paper comprising fibers distinct from fibers of the fibrous substrate, the security tape comprising an adhesive and at least one security element, wherein the security tape is at least partially incorporated within the fibrous substrate, and wherein the security tape extends continuously between two edges of said fibrous substrate.

2. The security sheet as claimed in claim 1, wherein said security tape extends between two opposite edges of said security sheet.

3. The security sheet as claimed in claim 1, wherein said paper security tape is based on cellulosic fibers and/or natural organic fibers other than cellulosic fibers and/or synthetic fibers and/or mineral fibers.

4. The security sheet as claimed in claim 3, wherein said paper security tape comprises at least 50% of cellulosic fibers.

5. The security sheet as claimed in claim 1, wherein said paper security tape is based on hydrophilic fibers.

6. The security sheet as claimed in claim 4, wherein said fibrous substrate is based on cellulosic fibers and/or natural organic fibers other than cellulosic fibers and/or synthetic fibers and/or mineral fibers.

7. The security sheet as claimed in claim 1, wherein said fibrous substrate and said paper security tape are based on the same types of fibers.

8. The security sheet as claimed in claim 7, wherein said fibrous substrate and said paper security tape are based on the same fibers in the same proportions in the case of two or more sorts of fibers.

9. The security sheet as claimed in claim 1, wherein said security tape has a width between 2 and 60 mm.

10. The security sheet as claimed in claim 9, wherein said security tape has a width between 4 and 30 mm.

11. The security sheet as claimed in claim 10, wherein said security tape has a width between 10 and 20 mm.

12. The security sheet as claimed in claim 1, wherein said security tape has a thickness between 20 and 120 μm.

13. The security sheet as claimed in claim 12, wherein said security tape has a thickness between 30 and 80 μm.

14. The security sheet as claimed in claim 13, wherein said security tape has a thickness between 45 and 55 μm.

15. The security sheet as claimed in claim 1, wherein said security tape is calendered.

16. The security sheet as claimed in claim 1, wherein said security tape comprises at least one watermark pattern.

17. The security sheet as claimed in claim 16, wherein said fibrous substrate and said security tape each comprise at least one watermark pattern and in that said patterns are complementary to one another by superimposition and/or combination.

18. The security sheet as claimed in claim 17, wherein the security tape has a different color from that of the substrate.

19. The security sheet as claimed in claim 1, wherein said fibrous substrate comprises at least one watermark pattern.

20. The security sheet as claimed in claim 1, wherein said paper security tape comprises at least one security element selected from markers, security fibers, flat and relatively small format security elements and security threads, and combinations thereof.

21. The security sheet as claimed in claim 20, wherein said security tape comprises at least two security elements.

22. The security sheet as claimed in claim 21, wherein said paper security tape comprises between 0.2 and 0.6% by dry weight of magnetic fibers in comparison with the total weight.

23. The security sheet as claimed in claim 20, wherein said paper security tape comprises between 0.1 and 1% by dry weight of magnetic fibers in comparison with the total weight of fibers.

24. The security sheet as claimed in claim 20, wherein said paper security tape comprises a plurality of planchets distributed in a surface density of between 4,000 and 25,000 planchets/$m^2$.

25. The security sheet as claimed in claim 24, wherein said paper security tape comprises a plurality of planchets distributed in a surface density between 5,000 and 20,000 planchets/$m^2$.

26. The security sheet as claimed in claim 25, wherein said paper security tape comprises a plurality of planchets distributed in a surface density between 11,000 and 18,000 planchets/$m^2$.

27. The security sheet as claimed in claim 20 wherein said security tape comprises a series of parallel security threads, the succession of inter-thread spaces and/or the series of the various widths of said security threads constituting a code.

28. The security sheet as claimed in claim 20, wherein said paper security tape comprises a anti-theft thread having soft magnetism.

29. The security sheet as claimed in claim 20, wherein said paper security tape comprises at least one chemical or biochemical reagent for antifalsification and/or authentication and/or identification, reacting in a colored manner to at least one falsification and/or authentication and/or identification agent respectively.

30. The security sheet as claimed in claim 29, wherein said security tape and said fibrous substrate of the security sheet each comprise at least one chemically incompatible chemical or biochemical antifalsification and/or authentication and/or identification reagent.

31. The security sheet as claimed in claim 1, wherein said security tape comprises at least one electronic device.

32. The security sheet as claimed in claim 1, wherein said substrate comprises, in addition to said security tape, at least one other security element selected from markers, security fibers, flat and relatively small format security elements and security threads, and combinations thereof.

33. The security sheet as claimed in claim 32, wherein said fibrous substrate comprises at least one chemical or biochemical reagent for antifalsification and/or authentication and/or identification, reacting in a colored manner to at least one falsification and/or authentication and/or identification agent respectively.

34. The security sheet as claimed in claim 1, wherein said security tape comprises perforations.

35. The security sheet as claimed in claim 34, wherein said perforations constitute a pattern or a code.

36. The security sheet as claimed in claim 35, wherein the pattern or the code comprises at least one alphanumeric character or one ideogram.

37. The security sheet as claimed in claim 1, wherein the adhesive comprises polyvinyl acetate.

38. The security sheet as claimed in claim 1, wherein the tape comprises between 2 and 15 $g/m^2$ of the adhesive.

39. The security sheet as claimed in claim 38, wherein the tape comprises between 3 and 8 $g/m^2$ of the adhesive.

40. The security sheet as claimed in claim 1, wherein said security tape is free of a surface coating.

41. The security sheet as claimed in claim 40, wherein said security tape is free of a pigmented layer.

42. The security sheet as claimed in claim 1, wherein the adhesive comprises a water-activable adhesive agent.

43. The security sheet as claimed in claim 42, wherein said water-activable adhesive agent is a polyvinyl alcohol.

44. The security sheet as claimed in claim 43, wherein said water-activable adhesive agent is a polyvinyl alcohol partially hydrolyzed.

45. The security sheet as claimed in claim 1, wherein the adhesive comprises a heat sealing agent.

46. The security sheet as claimed in claim 1, wherein said paper security tape has a tensile wet strength higher than 30%.

47. The security sheet as claimed in claim 1, wherein said security tape is inserted in bulk or in window(s) in said fibrous substrate.

48. The security sheet as claimed in claim 1, wherein said fibrous substrate comprises a fibrous monolayer or comprises a plurality of fibrous layers.

49. The security sheet as claimed in claim 48, wherein said security tape and at least one of said fibrous layers of said fibrous substrate have different colors.

50. The security sheet as claimed in claim 1, wherein said fibrous substrate comprises at least two paper security tapes as described in claim 1.

51. The security sheet as claimed in claim 1, wherein the security tape is observable by topography in the film.

52. The security sheet as claimed in claim 1, wherein the security tape is observable by transparence in the film with the naked eye.

53. A method for fabricating the security sheet as claimed in claim 1, wherein said paper security tape is inserted by pasting between two fibrous layers of said substrate.

54. A security document comprising the security sheet as claimed in claim 1.

55. The security document as claimed in claim 54, wherein said security document is a means of payment, an identity document, a property deed, a diploma, a lottery ticket, a transportation ticket or else an entrance ticket to cultural or sports events.

56. An article to be authenticated comprising the security sheet as claimed in claim 1, said article being selected from a security label, a container, a sheet used in the medical or hospital field, or else an art paper.

57. A method for authenticating the security sheet as claimed in claim 1 wherein the reaction between an antifalsification and/or authentication and/or identification reagent and a falsification and/or authentication and/or identification agent respectively, causes a staining of said paper security tape making said perforations observable on said security tape.

58. A method for fabricating the security sheet as claimed in claim 1, wherein the security sheet is formed by a papermaking process which comprises the following steps:

in the wet end of the papermaking process, said paper security tape is inserted into said fibrous substrate in formation, the substrate-tape combination thereby obtained is pressed, the assembly is then dried.

59. The fabrication method as claimed in claim 58, wherein said paper security tape is inserted in the wet end, in bulk or in window(s) into said fibrous substrate.

60. The fabrication method as claimed in claim 58, wherein said paper security tape is introduced in the wet end, on a paper machine equipped with at least one cylinder mold, in the mold of said cylinder mold and before or shortly after the start of the drainage of said fibrous substrate in formation.

61. The fabrication method as claimed in claim 58, wherein said paper security tape is introduced in the wet end, on a paper machine equipped with at least one Fourdrinier, above said Fourdrinier during the drainage of said fibrous substrate in formation.

62. The fabrication method as claimed in claim 58, wherein said fibrous substrate comprises at least two fibrous plies, and in that said paper security tape is introduced in the wet end, between two successive plies and before their joining.

63. A security sheet comprising:

a fibrous substrate; and a security tape made of paper comprising fibers distinct from fibers of the fibrous substrate, the security tape extending continuously between two edges of said fibrous substrate, and comprising a watermark, wherein the security tape is at least partially incorporated within the fibrous substrate.

64. A security sheet comprising:

a fibrous substrate; and a security tape made of paper comprising fibers distinct from the fibrous substrate, and extending continuously between two edges of said fibrous substrate, said security tape having a different color from at least one layer of said fibrous substrate, wherein the security tape is at least partially incorporated within the fibrous substrate.

* * * * *

UNITED STATES PATENT AND TRADEMARK OFFICE

CERTIFICATE OF CORRECTION

PATENT NO. : 8,376,409 B2
APPLICATION NO. : 12/443550
DATED : February 19, 2013
INVENTOR(S) : Rosset It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 672 days.

Signed and Sealed this
First Day of September, 2015

Michelle K. Lee

Michelle K. Lee
*Director of the United States Patent and Trademark Office*